US005141116A

United States Patent [19]

Mojica

[11] Patent Number: 5,141,116

[45] Date of Patent: Aug. 25, 1992

[54] SURFBOARD STORAGE RACK

[75] Inventor: Joel Mojica, San Diego, Calif.

[73] Assignee: Joel Mojica Company, San Diego, Calif.

[21] Appl. No.: 628,175

[22] Filed: Dec. 17, 1990

[51] Int. Cl.[5] ..... A47F 7/00

[52] U.S. Cl. ..... 211/60.1; 211/87

[58] Field of Search ..... 211/87, 60.1, 70.5, 211/70.8, 106; 224/922, 320, 325, 917

[56] References Cited

U.S. PATENT DOCUMENTS

| | | | |
|---|---|---|---|
| 2,099,507 | 11/1937 | Wright | 211/106 |
| 2,205,099 | 6/1940 | Lentz | 211/106 X |
| 3,115,107 | 12/1963 | Glenny | 211/106 X |
| 4,582,203 | 4/1986 | Davis | 211/70.8 |
| 4,779,743 | 10/1988 | McKinhon | 211/106 X |
| 4,878,585 | 11/1989 | Orestano | 211/87 |
| 4,886,173 | 12/1989 | Goulter | 211/89 |

*Primary Examiner*—Robert W. Gibson, Jr.

*Attorney, Agent, or Firm*—Knobbe, Martens, Olson & Bear

[57] ABSTRACT

A rack for storing a plurality of surfboards in upright orientations has a main rack section that is serpentine in shape. The curves in the rack establish a plurality of storage bays. Each storage bay has an arcuate central wall and outwardly diverging sides. Brackets are attached to the free ends of the rack to permit mounting the rack on a wall. If desired, one or more curved extension pieces can be connected to the free ends of the rack to permit storing additional surfboards. A protective covering is also attached to the rack.

23 Claims, 2 Drawing Sheets

FIG. 3
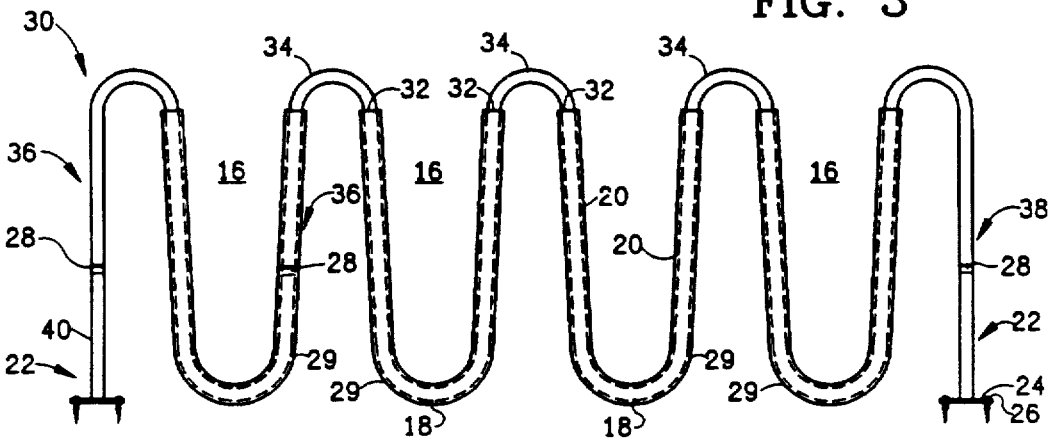
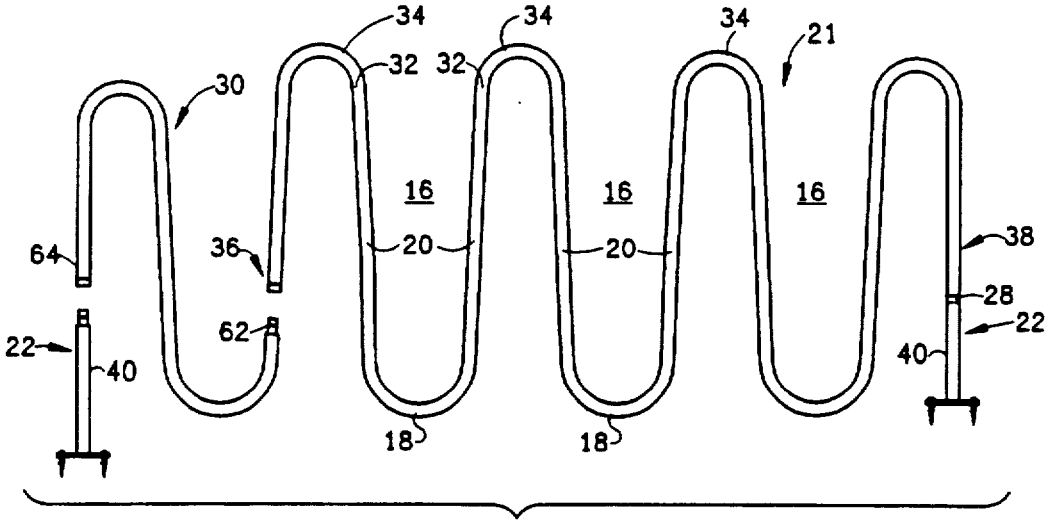
FIG. 4
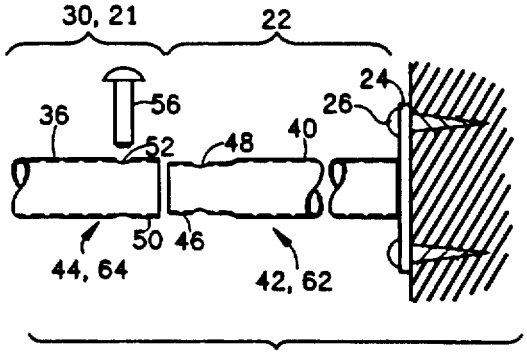
FIG. 5
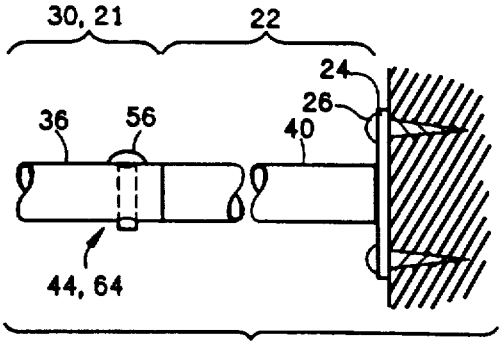
FIG. 6

SURFBOARD STORAGE RACK

FIELD OF THE INVENTION

This invention relates generally to the storage of multiple surfboards while not in use and more particularly to a surface-mounted expandable rack slotted to receive one or more surfboards.

BACKGROUND OF THE INVENTION

The sport of surfing has existed for many years and continues to be a popular diversion for those people fortunate to travel within range of any ocean coastlines. Surfing continues to grow in its attraction to young people as well as the older people who wish to retain that youthful vigor for life. However, while it is merely a pastime for some, it is taken quite seriously by others. In fact the avid surfer will often be equipped with a selection of several sleek and dynamic surfboards.

One of the problems with the sport of surfing is the cumbersome shape and size of the surfboard. During use, the beach is a vast available store area. However, when not in use, the surfboard is impractical to store away-even temporarily. Like snow skis, surfboards are difficult to transport in vehicles without some arrangement of open windows or raised hatches. The problem is further exasperated at surfing social hangouts where the surfers arrive with boards in hand. The storage of the boards is often sloppy at best.

The conventional method for storing multiple surfboards indoors is through the use of wall supports. Generally the wall support consists of one or more bays defined by a series of wooden dowels placed horizontally into vertical surfaces leaving a cantilevered portion exposed, which in turn, forms the sides of each bay. Sometimes the dowels are mounted on a manifold piece of wood, which manifold is mounted to the vertical surface. In the alternative, the dowels themselves are mounted directly in to the wall. In either case, the surfboards are then stowed away by standing them in a longitudinally vertical position against the wall in between a corresponding set of dowels.

While the dowels are effective to some degree, they do not permit the most efficient and effective storage of surfboards. Because of the generally loose fit of the bays between each set of dowels, the surfboards are prone to sliding down or falling over. In addition, where additional bays are desired, they are not so easily provided. Additional dowels must be mounted into the wall or additional manifold pieces must be obtained which generally are only available with a preset number of dowels. As a result, the system is not very flexible in accommodating a change in the number of bays required.

It would therefore be a novel improvement to provide a surfboard storage system that is more efficient and effective in the organized storage of surfboards. In particular, there is a need for a system that grasps the rim of the surfboard in such a manner that it is easy to remove the surfboard, yet sufficiently constructed to prevent the surfboard from sliding down or falling over. In addition, it would be a novel improvement to provide a surfboard storage system that is easily expandable while capable of variable use.

SUMMARY OF THE INVENTION

The instant invention provides an effective means to store multiple surfboards using a minimum of space while simultaneously preventing the surfboards from sliding down or falling over. In addition, the instant invention provides the ability to facilitate expansion in order to accommodate a larger number of surfboards as the user desires.

The present invention comprises an expandable surfboard rack having a main rack section, a set of discrete rack legs and, where necessary, individual rack extension pieces which permit expansion of the surfboard rack. In one preferred embodiment, the main rack section of the surfboard storage rack is fashioned out of a long metal tube shaped into an oscillating sinusoidal coil, thereby creating a series of contiguous U-shaped slots or bays. Each bay in the main rack section is sufficient in width to accommodate the thickness of a standard surfboard, while the well of each bay is shaped to receive the rim of the surfboard.

Each bay of the storage rack is shaped with an arcuate well and openly diverging sides. In one preferred embodiment, the main rack section provides three surfboard storage bays, wherein additional bays may be provided by adding one or more extension pieces. To complete a basic rack system, each rack leg is connected at a corresponding end of the main rack section, wherein the storage rack may be mounted on a flat surface.

Each rack leg consists generally of a short length of metal tubing, similar to that used in the main rack section or any other material suitably sturdy, and a flat bracket plate orthogonally attached to one end of the short leg. At the other end of each leg is a mechanical connector capable of mating with a corresponding mechanical connector at the end of the main rack section. The outer diameter of the free end of the short leg tubing is slightly narrower than the inner diameter of the main rack section and the balance of the rack legs, such that the free end may slidably engage the main rack section.

When the mechanical connectors are engaged, a mechanical fitting is used to secure the rack leg to the main rack section. When both legs are attached to the main rack section, the exterior surface of the legs are set flush with the exterior surface of the main rack section, providing a smooth, continuous-appearing connection.

The individual rack extension pieces are formed of similar metal tubing or alternative suitable material and fashioned into an imperfect S-shape. The extension pieces are identically shaped and capable of connecting to the main rack section and to each other so that the main rack section may be expanded to provide additional bays. At one end of each extension piece a connector is provided identical to that provided on the rack legs. Where an additional bay is desired, an extension piece may be connected to the main rack section in lieu of a rack leg. At the other end of the extension piece a second connector is provided identical to that provided on the end of the main rack section.

It is intended that when an extension piece is in place, one rack leg may connect directly to the extension piece in a similar fashion as if it were connected directly to the main rack section. If additional bays are required, supplemental extension pieces may be connected adjacent to the first extension piece. The rack leg is then connected in place to complete the storage rack. With this system, the rack is easily expandable by simply removing one rack leg and placing any number of extension pieces in between the main rack section and the rack leg.

In order to provide a snug fit for the surfboard within the bay well, a resilient material covering is provided. It is contemplated that the resilient material be a type of neoprene or any other suitably resilient material. The neoprene need not necessarily cover the entire rack, but may cover only as much of each bay as required to provide a snug fit. With the surfboard rim snugly fit within the well, the surfboard is prevented from slipping down or falling over.

The present invention is versatile enough to be used either by itself on a vertical surface or in conjunction with another identical rack on both vertical and horizontal surfaces.

BRIEF DESCRIPTION OF THE DRAWINGS

FIG. 3 is a top view of the embodiment illustrated in FIG. 1.

FIG. 4 is a top view of the embodiment illustrated in FIG. 1 showing one segment of the surfboard rack disconnected from its adjacent segments.

FIG. 5 is an exploded view of the wall bracket and a portion of the surfboard storage rack of the present invention with a segment end disconnected from the wall bracket to illustrate one preferred arrangement for interconnecting segments of the surfboard rack.

FIG. 6 is an exploded view of the wall bracket of FIG. 5 showing the surfboard rack segments in assembled configuration.

DETAILED DESCRIPTION OF THE INVENTION

Reference is now made to the figures wherein like parts are designated with like numerals throughout.

Figure 1:
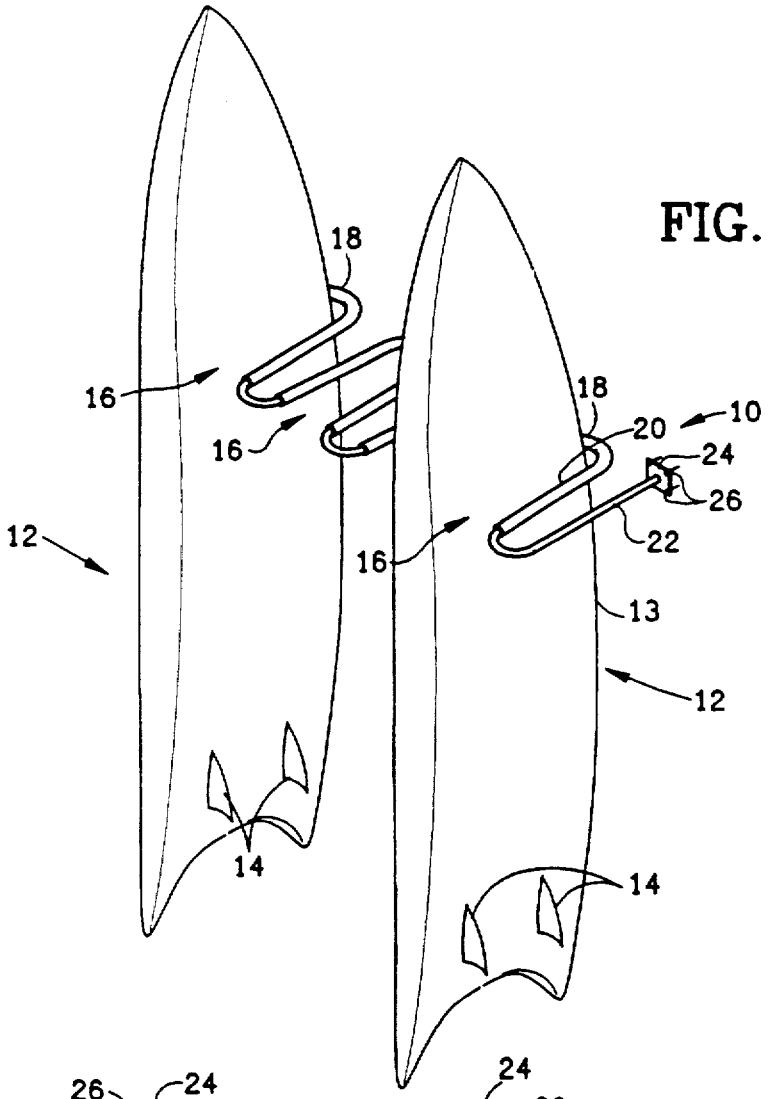
FIG. 1 is a perspective view of one presently preferred embodiment of the invention illustrating one surfboard storage rack installed horizontally on a flat surface with two surfboards vertically stored therewithin.
Figure 2:
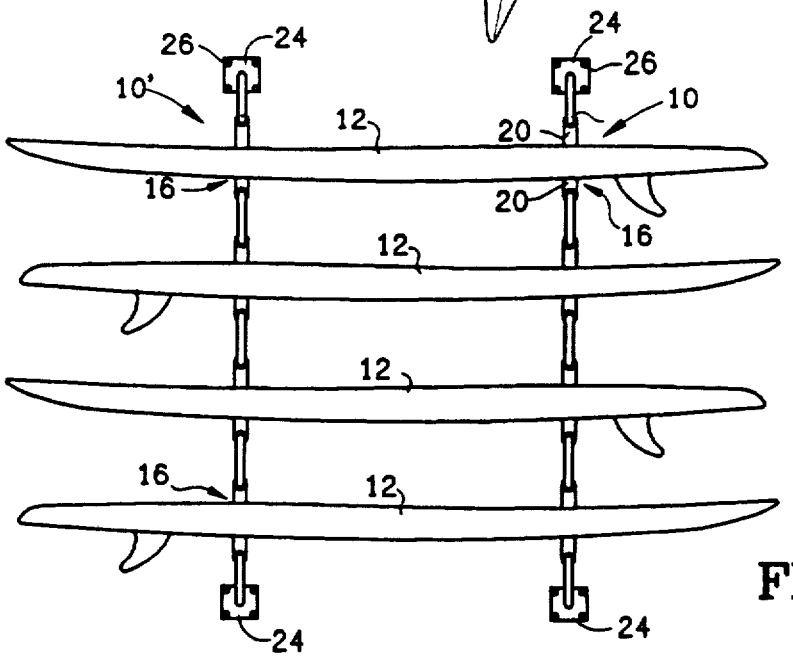
FIG. 2 is a front elevational view of a presently preferred embodiment of the invention wherein two surboard storage racks are shown installed vertically and parallel to each other with four surfboards horizontally stored therewithin.

As shown in FIG. 1, the present invention comprises an expandable surfboard storage rack 10 in which a plurality of surfboards, generally indicated at 12, each having a peripheral rim 13 and a keel 14, are stored. The preferred embodiment of the expandable rack is configured to permit each surfboard to be stored in one of a plurality of individual rack bays, generally indicated at 16, each bay having a bay well 18 and bay sides 20. The surfboard storage rack 10 is capable of being mounted to a mounting surface, such as a wall, in a horizontally position, thereby storing multiple surfboards in a vertical position as shown in FIG. 1. In addition, the storage rack may be mounted in a laterally-vertical position, wherein the individual rack bays 16 extend vertically upwardly, or in a longitudinally-vertical position, wherein the individual rack bays 16 extend horizontally outward. Referring to FIG. 2, it can be seen that when the storage rack 10 is mounted in a longitudinally-vertical position in conjunction with a second storage rack 10', multiple surfboards may be stored horizontally in a stacked formation.

Referring now to FIG. 3, it may be seen that in the preferred embodiment, the expandable surfboard rack 10 is constructed of at least one main rack section 21 and a pair of discrete rack legs 22. Each rack leg 22 is provided with its own mounting bracket 24 so that when two legs are connected to the main rack section 21, the expandable rack 10 may be mounted directly to a mounting surface using the mounting brackets 24 and bracket bolts 26. The rack legs 22 are fastened to the main rack section 21 at rack connections 28 which consist of mechanical type connections, discussed further below in association with FIGS. 5 and 6. Advantageously, the expandable rack 10 may be extended to provide additional storage rack bays 16 by merely adding one or more individual rack extension pieces 30 as discussed in more detail below.

An additional component of the preferred embodiment is a resilient covering 29 which not only protects the rack from dents and scratches, but is sufficiently resilient to provide a snug fit around the surfboard. It is contemplated that the resilient material be a spongy fabric such as neoprene; however, any suitably resilient material will be effective. The neoprene covering 29 need not necessarily cover the entire rack, but may be provided in discrete sections to cover only a portion of each bay—at least the bay well 18 and a portion of each bay side 20, as is illustrated for the preferred embodiment in FIG. 3. With the surfboard rim 13 snugly fit within the bay well 18, the surfboard 12 is prevented from slipping down or falling over.

Referring to FIG. 4, it may be seen that the preferred embodiment comprises the main rack section 21 and two rack legs 22. Furthermore, where necessary, one or more extension pieces, generally indicated at 30, may be inserted between the main rack section 21 and one of the rack legs 22. In the preferred embodiment, the main rack section 21 of the expandable storage rack 10 comprises a rigid rod, made of a long metal tube or plastic rod, fashioned into an oscillating sinusoidal coil, thereby creating a series of contiguous U-shaped slots or bays 16. Each rack bay in the main rack section 21 is sufficient in width to accommodate the thickness of a conventional surfboard 12, while the bay well 18 of each rack bay 16 is shaped to snugly receive the rim 13 of the surfboard 12 (FIG. 1). It is to be noted that while metal tubing is an effective durable material, the interior need not be hollow, and an exterior tubular configuration is not required; The rack section 21 could comprise any shape which would receive and secure a surfboard within its bays 16. Of course, other equally effective materials are available that may also be fashioned in such an oscillative configuration, including molded plastic or any other material.

Each rack bay 16 of the preferred embodiment is shaped with an arcuate bay well 18 and openly diverging bay sides 20, although a constant-width bay would also be effective. An end 32 of each bay side 20 is returned in an arcuate shape to form a return portion 34 integrally connecting the end 32 of one bay with the end 32 of an adjacent bay. As shown in FIG. 1, the return portions, generally indicated at 34, separate one rack bay 16 from another and are directed outwardly away from the mounting surface.

The main rack section 21 is configured so that an extension end 36 terminates at a finite distance from a last return portion 34 at one end of the main rack section, but at a distance less than that required to form the bay well of another rack bay. Similarly, a mounting end 38 of the main rack section, positioned oppositely from the extension end 36, equally terminates at a finite distance from a last return portion 34 at the other end of the main rack section and at a distance less than that required to form the bay well of another rack bay. While it is intended that the central piece of the preferred embodiment provide three adjacent surfboard bays, as illustrated, it will be obvious to configure the main rack section in varied lengths to incorporate any number of adjacent storage bays.

Referring still to FIG. 4, the expandable capability of the present invention may be appreciated. There it may be seen that individual rack extension pieces 30 of the preferred embodiment are formed of metal tubing or alternative suitable material, similar to that of the main rack section 21 and rack legs 22, and are fashioned into an imperfect S-shape. The rack extension pieces 30 are preferably identical in shape, each configured to provide at least one additional storage bay 16. The extension pieces 30 are further provided with end connectors capable of interconnecting with the main rack section 21 and to each other so that the main rack section 21 may be expanded in series to provide an infinite amount of additional bays. A description of the interconnection of a piece 30 to the main rack section 21 is provided in reference to FIG. 6.

In the preferred embodiment of a basic storage rack, one rack leg 22 is connected at the extension end 36 and another rack leg 22 is connected at the mounting end 38 of the main rack section 21. Having two rack legs 22 effectively secured to the main rack section 21, the storage rack 10 may be mounted via the mounting bracket 24 on any mounting surface. It is to be understood that while the storage rack 10 may be advantageously arranged as shown in FIGS. 1 and 2, other arrangements are obviously possible. For example two storage racks 10 may be mounted, at a finite distance apart, on the roof of a vehicle so one or more surfboards !2 may be laterally stored similarly to conventional means of storing snow skis.

Referring to FIG. 5, it may be seen that each rack leg 22 consists generally of a short tube 40 made of metal, similar to that used in the main rack section 21, or any other material suitably sturdy. Orthogonally attached at one end of the short tube 40 is one of the mounting brackets 24. At the other end of the short tube 40, a mechanical male connector 42 is provided, wherein the male connector mates with a corresponding female connector 44, positioned at the extension end 36 and mounting end 38 of the main rack section 21, to form rack connections 28. In this respect, a rack leg 22 may be readily connected to both ends of the main rack section 21 and mounted jointly to the mounting surface.

In the preferred embodiment, the male connector 42 of each rack leg 22 consists of a short male extension 46 having two concentric apertures 48 located proximate to the end of the male connector 42 and positioned opposite each other about the cross-sectional midpoint of the short tube 40. The outer diameter of the male extension 46 is slightly narrower than the inner diameter of the female connector 44 of the main rack section 21, such that the rack leg 22 may slidably engage the main rack section. The corresponding female connector 44 of the main rack section, identical at both the extension end 36 and the mounting end 38, consists of a female extension 50, having a similar set of concentric apertures 52 located proximate to the end of the female connector 44 and positioned opposite each other about the cross-sectional midpoint of the main rack section 21. When the apertures 48 and 52 of the leg and main rack section, respectively, are in concentric alignment, a mechanical fitting 56 may be slidably inserted through both sets of apertures to secure the rack leg 22 to the main rack section 21. In the preferred embodiment, the mechanical fitting 56 consists of a metal screw. However, other embodiments of the mechanical fitting may consist of other connectors, such as a nut and bolt arrangement.

If there is required additional bays, one or more extension pieces 30 may be inserted to expand the storage rack 10. The mechanical connection between the main rack section 21 and the two rack legs 22 is identical to the mechanical connection between an extension piece 30 and the main rack section and rack leg 22. Provided at one end of each extension piece 30 is a male connector 62 identical to the male connector 42 of the rack legs 22, thereby permitting interchangeability between the extension piece 30 and the rack leg 22. At the other end of the extension piece 30, a female connector 64 is provided identical to the female connector 44 located at each end of the main rack section 21.

When an additional bay is desired, the rack leg connected to the extension end 36 of the main rack section is disconnected and a first extension piece 30 substituted therefor. When the extension piece 30 is in place, the disconnected rack leg is then connected directly to the free end of the extension piece in a similar fashion as if it were connected directly to the main rack section. If more than one additional bay is required, supplemental extension pieces may be advantageously connected adjacent to the first extension piece. The disconnected rack leg is then connected in place to complete the expanded storage rack. With this system, the rack is easily expandable by simply removing one rack leg and placing any number of extension pieces in between the main rack section and the rack leg connected to its mounting end.

Referring to FIG. 6, it may be seen that the rack leg 22 is connected to the main rack section 21. When both rack legs 22 are attached to the main rack section 21, the exterior surface of the rack legs is positioned substantially flush with the exterior surface of the main rack section, thereby providing a smooth, continuous-appearing rack connection 28.

The storage rack 10 of the present invention is versatile to be used either by itself on a vertical surface or in conjunction with another identical storage rack on both vertical and horizontal surfaces. Where the instant invention is used by itself, it is contemplated that the storage rack 10 will be mounted in a horizontal fashion against a vertical surface such that the individual storage bays 16 open outwardly, as shown in FIG. 1. Surfboards 12 may then be vertically stowed longitudinally in each storage bay 16 so that the stored surfboards will preferably stand parallel and adjacent to each other. It is intended that the bay wells 18 be separated by a distance greater than the height of a surfboard keel 14 to prevent the surfboard keel of one surfboard from contacting an adjacent surfboard, thereby further preventing damaged when stored.

It is also contemplated that surfboards may be effectively stored by using two racks mounted on either a vertical or horizontal surface and spaced at a distance shorter than the length of a conventional surfboard. Where mounted on a vertical surface, the two storage racks are longitudinally mounted vertically so that individual surfboards may be stored horizontally in a stacked fashion, as shown in FIG. 2. Where mounted on a horizontal surface, such as the top of a vehicle, the two storage racks are laterally mounted vertical such that the storage bays extend upward. Individual surfboards may then be stowed laterally vertical. On occasions where two racks are desired, the distance between bay wells 18 may be less than the height of the surfboard keels 14, as the surfboards may be staggered to prevent damage to the keels.

The present invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

WHAT IS CLAIMED:

1. A surfboard storage rack comprising:

a main rack section having a first extension end and a mounting end;

a plurality of extension pieces;

means for connecting each extension piece to a corresponding end of the main rack section; and a resilient protective fabric for covering at least one portion of the main rack section.

2. A surfboard storage rack as defined in claim 1 Wherein the main rack section comprises a first rigid rod fashioned into a plurality of contiguous U-shaped storage bays.

3. A surfboard storage rack as defined in claim 2 wherein the first rigid rod comprises a metal tube.

4. A surfboard storage rack as defined in claim 2 wherein the first rigid rod comprises a solid plastic construction.

5. A surfboard storage rack as defined in claim 2 wherein the U-shaped storage bays each comprise an arcuate centrally-positioned well and two outwardly diverging sides.

6. A surfboard storage rack as defined in claim 5 wherein the first extension end is located at a first end of the main rack section and the mounting end is located at a second end of said main rack section.

7. A surfboard storage rack as defined in claim 6 wherein a first and second extension piece each comprise a surface mounting extension, said surface mounting extension further comprising a leg having a flat bracket attached orthogonally at one end and a first tubular projection at the other end.

8. A surfboard storage rack as defined in claim 7 wherein a third extension piece comprises a second rigid rod having a second extension end at a first end thereof, a second tubular projection at a second end thereof, and wherein said third extension piece is configured to define at least one U-shaped storage bay positioned between said second extension end and said second tubular projection, said second extension end having a construction substantially identical to the first extension end of the main rack section and said second tubular projection having a construction substantially identical to the first tubular projection.

9. A surfboard storage rack as defined in claim 8 wherein a plurality of additional third extension pieces are connected to the main rack section to permit formation of additional storage bays.

10. A surfboard storage rack as defined in claim 1 wherein the resilient fabric comprises a neoprene wrapping covering the well of each of the adjacent storage bays.

11. A surfboard storage rack comprising:

a main rack section having an extension end and a mounting end, said main rack section further comprising a first rigid rod fashioned into a plurality of contiguous U-shaped storage bays, wherein the U-shaped storage bays comprise an arcuate centrally-positioned well and two outwardly diverging sides;

a first mounting section having a flat bracket attached orthogonally at one end;

a second mounting section having a flat bracket attached orthogonally at one end;

at least one extension section;

means for interconnecting the mounting sections and the extension section alternatively with each other and with the main rack section; and a resilient protective fabric covering said wells of each of the adjacent storage bays.

12. A surfboard storage rack as defined in claim 11 wherein the storage rack comprises a plurality of extension sections.

13. A surfboard storage rack as defined in claim 11 wherein the resilient protective fabric is neoprene.

14. A surfboard storage rack comprising:

a main rack section defining a continuous surface configured to form a plurality of bays, each bay comprising an arcuate, centrally-positioned well and first and second sides, and wherein each bay is sized to receive and secure a surfboard therein by frictional contact between the surfboard and said first and second sides; and means for anchoring said main rack section to a structural support surface.

15. A surfboard storage rack as defined in claim 14 wherein the storage bays are U-shaped and wherein the first and second sides are divergingly spaced outwardly from the well.

16. A surfboard storage rack as defined in claim 14 further comprising one or more extension pieces.

17. A surfboard storage rack as defined in claim 16 wherein the extension pieces are connected to and positioned in planar alignment with the main rack section.

18. A surfboard storage rack as defined in claim 14 further comprising a resilient protective fabric for covering at least one portion of the main rack section.

19. A surfboard storage rack as defined in claim 18 wherein the resilient fabric comprises a neoprene wrapping.

20. A surfboard storage rack as defined in claim 14 wherein the means for anchoring said main rack section to a structural support surface comprises a plurality of legs having a flat bracket attached orthogonally at one end and a first tubular projection at the other end.

21. A surfboard storage rack as defined in claim 14 wherein the main rack section comprises a first rigid rod fashioned into a plurality of contiguous U-shaped storage bays.

22. A surfboard storage rack as defined in claim 21 wherein the first rigid rod comprises a metal tube.

23. A surfboard storage rack as defined in claim 21 wherein the first rigid rod comprises a solid plastic construction.

* * * * *